United States Patent [19]

De Lott

[11] Patent Number: 4,700,409

[45] Date of Patent: Oct. 20, 1987

[54] CONVERTIBLE GARMENT

[75] Inventor: Stuart C. De Lott, Great Neck, N.Y.

[73] Assignee: Wingspread Corporation, New York, N.Y.

[21] Appl. No.: 1,460

[22] Filed: Jan. 8, 1987

[51] Int. Cl.[4] ..... A41D 1/00

[52] U.S. Cl. ..... 2/94; 2/102

[58] Field of Search ..... 2/93, 94, 85, 86, 89, 2/87, 97, 102

[56] References Cited

U.S. PATENT DOCUMENTS 4,475,251 10/1984 Hopkins ..... 2/94

4,476,587 10/1984 Itoi ..... 2/94

4,502,155 3/1985 Itoi ..... 2/94

*Primary Examiner*—Doris L. Troutman

*Attorney, Agent, or Firm*—Abelman Frayne Rezac & Schwab

[57] ABSTRACT

A convertible garment, such as a jacket, tunic or vest, includes a pouch concealed between inner and outer rear walls of the garment, and which can be withdrawn through an aperture in the inner rear wall of the garment for the pouch to be employed as a carrying bag for the garment when the garment is apropriately folded, the carrying bag provided by the pouch having an internal volume in excess of the volume of the garment when appropriately folded and stored within the carrying bag provided by the inverted pouch.

7 Claims, 5 Drawing Figures

FIG. 4
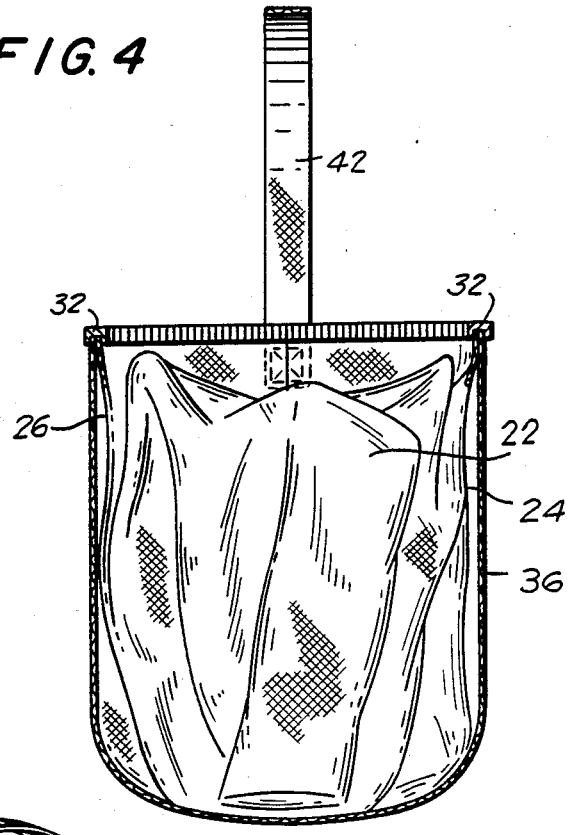
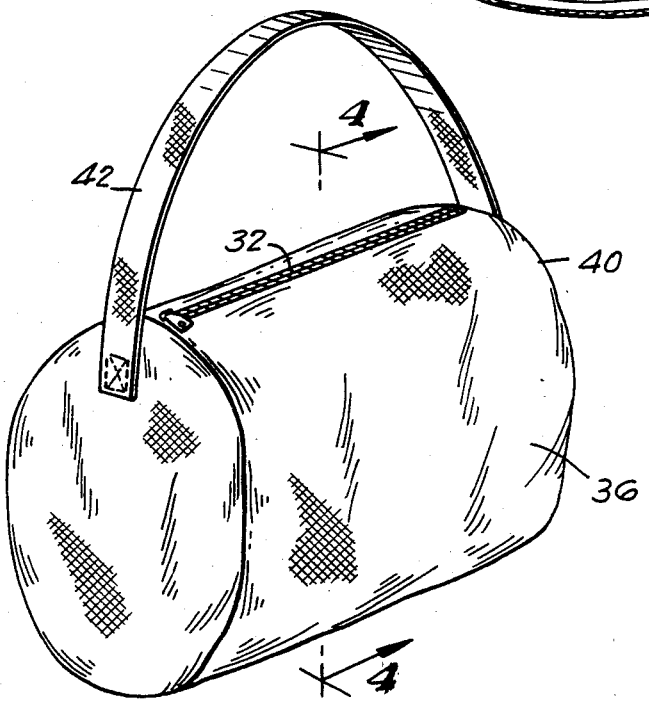
FIG. 5

CONVERTIBLE GARMENT

FIELD OF THE INVENTION

This invention relates to an outerwear garment, typically a jacket or the like garment as used by sportsmen, hunters, and other persons involved in outdoor activities.

BACKGROUND OF THE INVENTION

Convertible constructions of outerwear garments are known in the art which incorporate a concealed carrying bag within which the garment can be stored for ease of transportation at the time the garment is not required for use.

An example of such a convertible garment is disclosed in Breier U.S. Pat. No. 2,825,902 issued Mar. 11, 1958. Breier teaches a light-weight garment construction, such as a rain jacket, in which the yoke of the garment is of double walled construction, and is provided interiorly of the garment with a reversible slide fastener for closing an opening into the interior of the double-walled yoke.

Thus, in normal usage, the fastener is closed to connect the two walls of the yoke to each other at the opening positioned at the bottom edge of the yoke, and, the rain jacket is worn by the user in the usual manner.

If the user no longer requires the jacket for use as a rain jacket, then, upon removal of the garment, the user can open the slide fastener, fold the jacket appropriately, and then position the folded jacket within the envelope formed by reversing the inner and outer walls of the yoke with respect to each other, subsequent to which the envelope can be closed by use of the then reversed slide fastener.

While such a construction lends itself to relatively light-weight garments, such as those assembled from light-weight woven fabrics of cotton or synthetic materials, such a construction is limited to such a use, in that the internal volume of the envelope within which the folded garment is to be stored is relatively small and is limited in its size by the physical dimensions of the yoke. Further, the positioning of the slide fastener at the lower edge of the yoke can constitute a source of discomfort for the user, in that the slide fastener then lies directly over the upper regions of the shoulder blades of the user and can dig into the shoulder blades as the user exercises normal movements of the user's arms. Typically, the lower edge of the yoke lies at a central position or upwardly of the arm holes of the garment, at which position the yoke is subjected to tensioning at the time the user moves the user's arms forwardly.

Itoi in U.S. Pat. No. 4,502,154 issued Mar. 5, 1985 avoids these disadvantages, firstly by providing an opening in a front face of an outer garment at a position for it to extend across the lower rib cage of the user, and, by providing a storage pouch which normally is positioned between an inner and an outer front panel of the garment, and which can be pulled outwardly of the garment to provide a carrier bag for storage and transportation of the garment at the time the garment is not required for use and has been appropriately folded.

This construction, however, is encumbered with the disadvantage that an opening must be provided in the outer front panel of the garment, and, some means must be provided not only for closing that opening, but also, for preventing the seepage of water or moisture into the pouch when the garment is worn in inclement weather.

SUMMARY OF THE INVENTION

The present invention seeks to eliminate these disadvantages, firstly by providing a pouch of enhanced dimensions for storage of the garment when the garment is not in use, and which is of sufficient size that not only the folded garment can be stored within the pouch for transportation, but also, sufficient space is provided for the storage of other personal articles of the user, such as books, personal radios, comestibles and additional clothing.

Additionally, the pouch is of sufficient dimensions that it can store an outer garment of relatively heavy weight, such as fall or winter weight garments having a relatively thick and sturdy outer shell and a relatively bulky thermal lining.

Further, this is accomplished in the absence of providing unsightly closures exposed on the outer face of the garment, and additionally the opening into the storage pouch is provided at a location in which it is isolated from rain water, snow, or other moisture that possibly could seep into the pouch at the time the garment is in use.

According to the present invention, the convertible garment includes an outer shell which is fully or partially lined, and which includes a continuous outer rear panel, and an inner rear panel co-extensive with the outer rear panel and which in combination substantially provide the back section of the garment.

The inner rear panel is formed in two sections for it to provide a upper section providing a yoke terminating at its lower edge at a position spaced only slightly above the lowermost curvature of the arm holes of the garment, and a lower section that is continuous downwardly towards the lower edge of the garment, the lower edge of the lower rear panel either being directly attached to the lower edge of the outer rear panel, or hanging freely relative to the lower edge of the outer rear panel.

A pouch is provided within the back section of the garment, the pouch extending substantially the full width and height of the said lower section of the inner rear panel, and being directly attached at its upper rear edges, respectively, to the lower edge of the upper section of the inner rear panel and to the upper edge of the said lower section of the inner rear panel.

In this manner, not only are the dimensions of the pouch increased to a permissible maximum, but also, the opening to the pouch is positioned interiorly of the garment, thus isolating the pouch from water seepage at the opening into the pouch.

Further, the fasteners used for closing the opening are positioned at a location in which discomfort to the wearer of the garment is minimized. Conveniently, the fasteners are in the form of an invertible slide fastener.

DESCRIPTION OF THE DRAWINGS

A preferred embodiment of the present invention will now be described with reference to the accompanying drawings in which:

FIG. 4 is a diagrammatic cross-section illustrating the garment of FIGS. 1 through 3 when appropriately folded and positioned interiorly of the pouch of FIGS. 1 through 3, FIG. 4 being a transverse cross-section taken approximately on the line 4—4 of FIG. 5; and FIG. 5 is a perspective view illustrating the pouch of FIGS. 1 through 4 when assembled into a carrying bag.

DESCRIPTION OF THE PREFERRED EMBODIMENT

Figure 1:
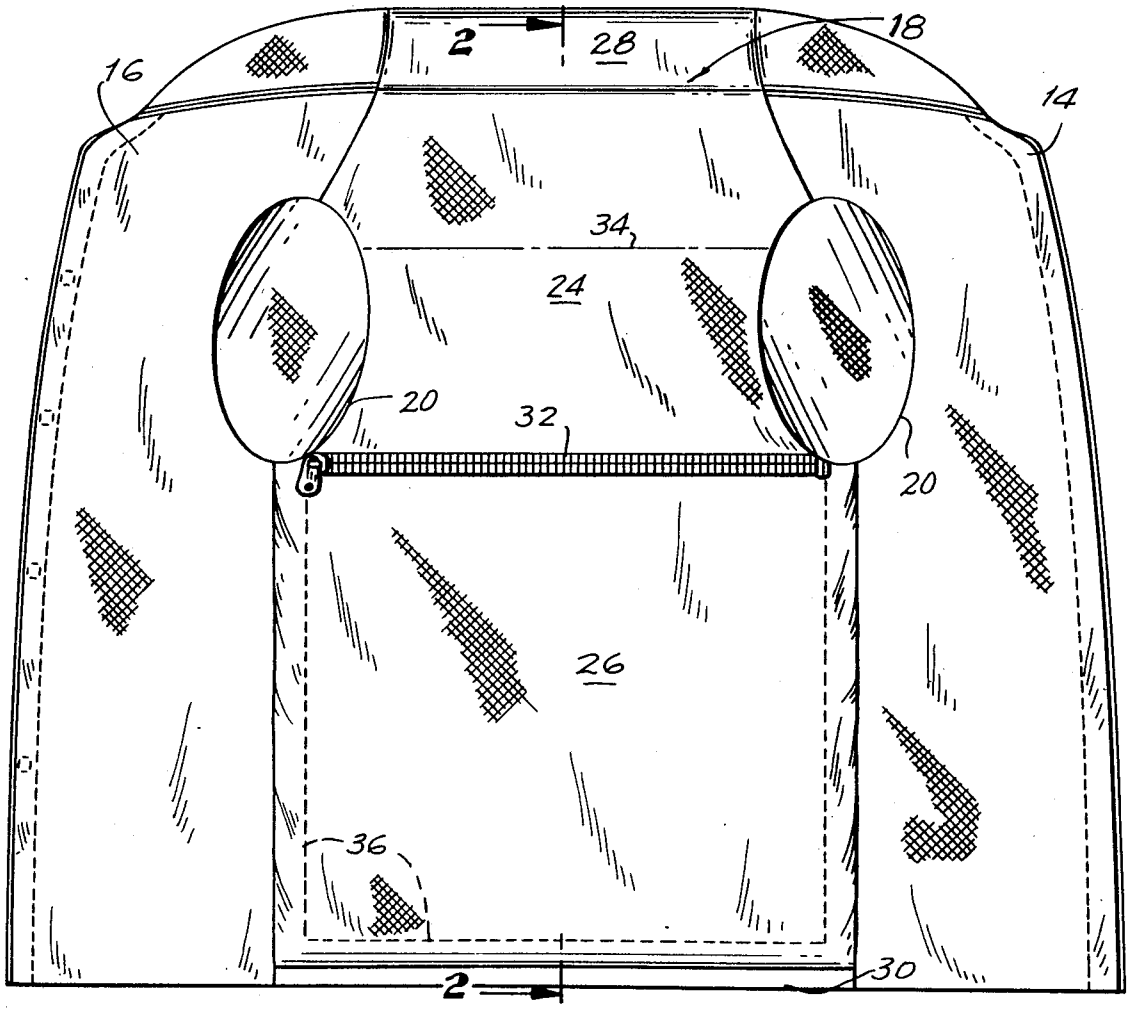
FIG. 1 is a frontal view of the internal surface of the convertible garment of the invention, showing the location of the concealed pouch.

Referring firstly to FIG. 1, the garment of the present invention typically is one comprised of left and right-hand frontal sections 14 and 16 which are connected by stitching and the like to a rear section 18, the garment appropriately being provided with arm holes 20 accomodating sleeves [not shown] of the garment, the garment in all of these respects being entirely conventional, and being a diagrammatic illustration of a typical outerwear garment as employed by persons involved in outdoor activities.

Figure 3:
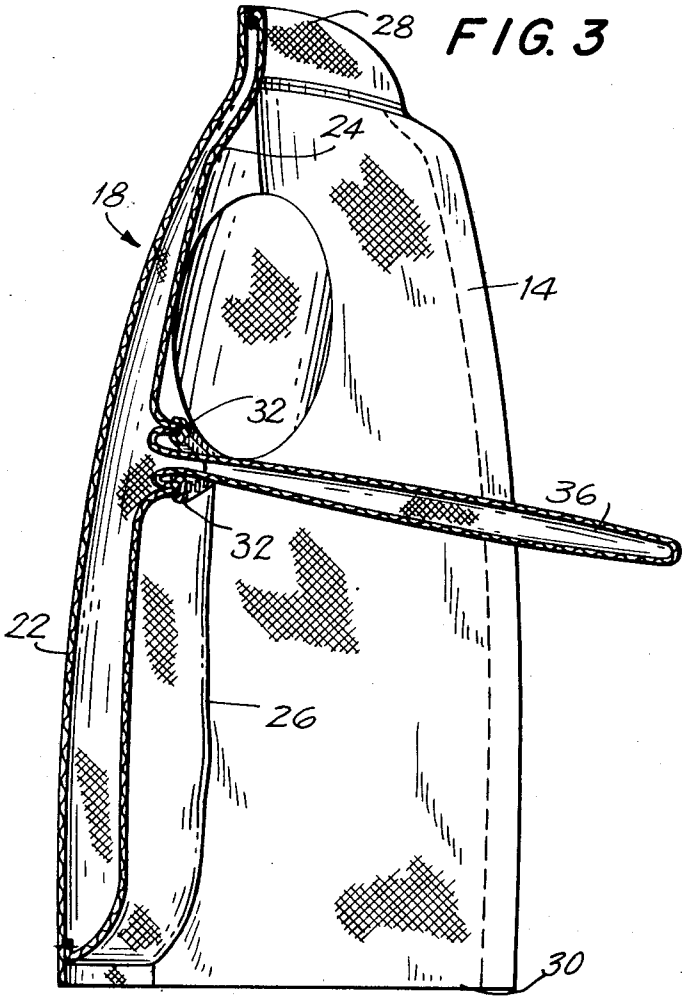
FIG. 3 is a cross-section corresponding with FIG. 2, but showing the concealed pouch withdrawn from its position of concealment between an outer rear panel of the garment and an inner rear panel thereof.
Figure 2:
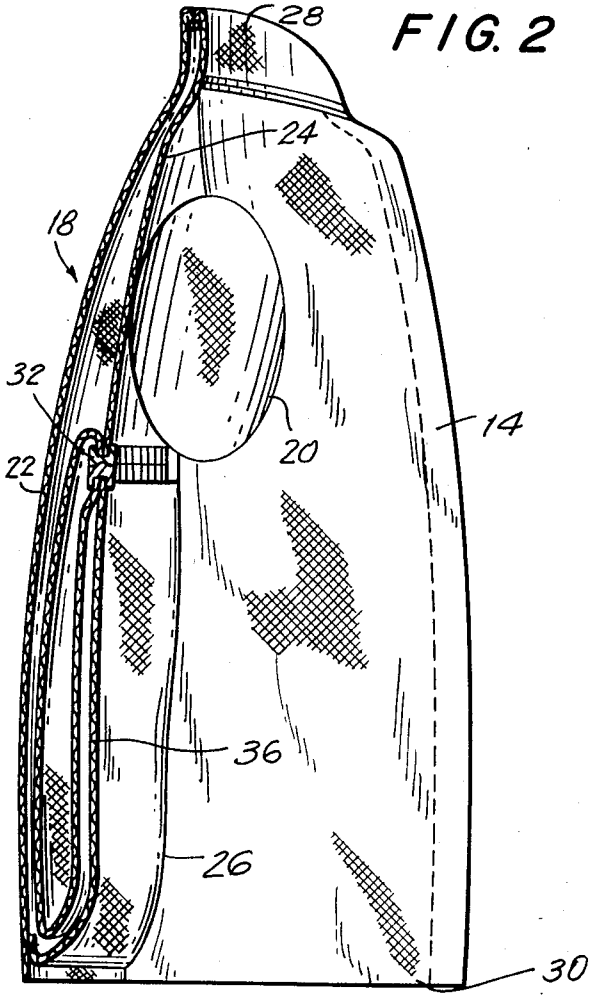
FIG. 2 is a vertical cross-section through the rear panel of the garment of FIG. 1, and is taken on the line 2—2 in FIG. 1.

Departing from this known prior art structure, the back section of the garment, indicated generally at 18 in FIGS. 2 and 3, is a composite structure comprising an outer back panel 22, and first and second inner rear panel sections 24 and 26, each of which appear in frontal view in FIG. 1.

The outer rear panel 22, as is conventional, is either comprised of a single panel providing the back face of the garment, or, and again as is conventional, is comprised of one or more panels suitably connected to each other by stitching in order to comprise a single and interrupted back panel, even though the back panel may have stitched seams, gussets, actual or simulated storm flaps, and other such constructions as are common in the art, the rear panel extending from a collar portion 28 of the garment in a continuous sweep down to the lower marginal edge 30 of the garment.

Departing from these conventional constructions, the convertible garment of the present invention provides an inner rear panel comprised of the upper and lower panel sections 24 and 26, the respective panel sections 24 and 26 being interconnected at their respective lower and upper edges by any convenient form of fastening means, such as by the illustrated slide fastener 32.

For reasons later discussed, the slide fastener 32 is of the reversible type, i.e., one having dual pull tabs arranged on opposite sides of the slide fastener in order that the slide fastener can be operated with equal facility from either side of the slide fastener.

The slide fastener 32 is positioned interiorly of the garment such that it is below the lower edge of the conventional yoke of a garment, i.e., at the position indicated diagrammatically by the chain dotted line 34. Preferably the slide fastener 32 extends between the lower curvatures of the arm holes 20, such that the slide fastener 32 is of approximately the same length as the major width of the back panel 18, and closely approximates the width of the lower section 26 of the inner back panel 24, 26.

Referring now more particularly to FIG. 2, positioned between the outer rear back panel 22 and the inner rear back panel section 24, is a pouch 36 which is closed at its bottom and side edges, and, at its top edges is connected respectively to the upper rear panel section 24 and to the lower rear panel section 26. Except for its connections at its upper edges to the rear panel sections 24 and 26, the pouch 36 otherwise is completely unattached to the remainder of the garment. The pouch 36 can be formed of any suitable light-weight and preferably water-resistant material, such as light-weight rubberized cotton fabric, or, a fabric woven from synthetic plastics material, or, less preferably, can be a sheet of flexible extruded plastics material such as vinyl sheeting.

At the time of wearing of the garment with the pouch in the position indicated in FIG. 2, and indicated by dotted lines in FIG. 1, the garment can be worn in an entirely conventional manner and without any discomfort to the user, in that the relatively thin and flexible pouch 36 will move readily with body motions of the user in unison with the outer rear panel 22 and the inner rear panel sections 24 and 26. Further, as the slide fastener 32 is positioned at a location lower than that of the usual yoke of a garment, the slide fastener itself will not be subjected to tensional stresses as the user moves his arms, the slide fastener 32 being located adjacent the softer part of the user's back rather than for it to be in spanning relationship with the user's shoulder blades.

In the event that the outerwear garment is no longer required for use by the user, then, that garment can be folded and stored in the manner now discussed with reference to FIGS. 3, 4 and 5.

Referring firstly to FIG. 3, it will be seen that the pouch 36 has been moved, and in fact turned inside out from its position shown in FIG. 2, by firstly unfastening the slide fastener 32, and then, reaching into the opening between the respective sections of the slide fastener, and, by then pulling the pouch 36 outwardly from its previous location between the back rear panel 22 and the back inner panel section 26, subsequent to which the garment can be folded by folding the rear sections 14 and 16 and the sleeves of the garment rearwardly into overlying relationship with the rear back panel 22, subsequent to which the folded garment can be moved into the pouch 36 as diagrammatically illustrated in FIG. 4.

The slide fastener then can be closed from its opposite side in the entirely conventional manner to form the pouch 36 into a conventional carrying bag 40 as illustrated in FIG. 5, the carrying bag preferably being provided with straps 42 for convenience in transportation of the bag 40.

Referring now more particularly to FIGS. 1 and 2, it will be seen that the pouch 36 extends almost the full height of the inner rear panel section 26. Thus, the circumference of the bag that can be formed by the pouch 36 is approximately double that of the height of the inner rear panel 26.

Thus, the pouch 36 is capable of forming an extremely comodious bag 40 which not only will accomodate the folded and stored garment, but which also will provide adequate space for the storage of further personal articles of the user, such as a sweater, books, a personal radio or comestibles such as packages of food, a thermos flask and the like. Further, when in its retracted position as illustrated in FIG. 2, the pouch 36 conveniently can serve for the protection and transportation of relatively flat articles such as maps, magazines or newspapers, which the user may find inconvenient to carry in the user's hands.

In view of the comodious capacity of the bag 40 formable from the pouch 36, restrictions are removed on the weight and bulk of the garment, which optionally can be formed from light-weight fabrics, but equally well can be formed from relatively heavy winter-weight fabrics, the outer shell of the garment conveniently being formed from a heavy weight woven blanket cloth, the inner facings of the garment additionally or alternatively being formed from a material having excellent thermal insulation properties, such as a relatively heavy-weight flannel, woven blanket cloth, or, a relatively bulky manufactured fur fabric, such as a simulation of fleece or animal fur.

It will be appreciated that various modifications may be made in the structure of the preferred embodiment as discussed above without departing from the scope of the appended claims, including various selections of materials and positioning, and, that if desire, the yoke of the garment can be provided with a conventional hood to cowl which is to be positioned between the outer rear panel 22 and the inner rear panel section 24, and which is withdrawable through an opening at the collar line of the garment.

While the invention has so far been described with reference to an open fronted garment such as a jacket, it will be appreciated that the invention finds equal application in a closed fronted garment, such as a tunic or a vest, the only requirement being that the tunic or vest be turned inside out prior to opening the slide fastener 32 and withdrawal of the pouch 36. Once so positioned, the tunic or vest can be stored within the pouch 36 with equal facility to the open fronted garment specifically discussed with reference to the preferred embodiment of the invention.

I claim:

1. A convertible garment of the type including a back section, at least one front section, and arm holes positioned adjacent a yoke of said garment, said back panel section including:

an outer continuous rear wall panel extending across the back face of said garment and having a lower free edge;

a first inner rear panel section positioned adjacent said outer rear wall panel and extending downwardly from a collar portion of said garment to a position intermediate said armholes, said first inner panel section terminating in a lower free edge extending transversely of said garment and between said arm holes;

a second inner rear panel section positioned adjacent said outer rear wall panel and extending downwardly from an upper free edge of said second inner rear panel section aligned with said lower free edge of said first inner rear panel section, said second inner rear panel section terminating at a lower edge thereof substantially in alignment with said lower free edge of said outer rear wall panel;

a pouch structure comprised of substantially parallel sheets of fabric material positioned between said outer rear wall panel and said second inner rear wall panel section, said pouch having top, bottom and side edges and being closed at said side edges and at said bottom edge;

the respective top edges of said pouch respectively being connected to said lower edge of said first inner rear panel section and said upper edge of said second inner rear panel section, said pouch extending substantially the entire height and width of said second inner rear panel section; and, fastener means for detachably attaching said lower edge of said first inner rear panel section to said upper edge of said second inner rear panel section; whereby, upon separation of said fastener means, said pouch can be inverted and withdrawn between said respective lower and upper edges of said respective first and second inner rear panel sections for it to be employed as a storage bag for said garment when said garment is appropriately folded, said storage bag provided by said pouch having an internal volume in excess of the volume of said folded garment.

2. The convertible garment of claim 1, in which said fastener means is a double-sided slide fastener.

3. The convertible garment of claim 1, in which said respective lower and upper edges of said respective first and second inner rear panel sections each extend tranversely of said garment at a position spaced downwardly of said yoke of said garment and between lower curvatures of said arm holes.

4. The convertible garment of claim 1, including a carrying strap removably positioned within said pouch, and which is exposed for use upon inversion of said pouch.

5. The convertible garment according to claim 1, in which said rear wall of said garment is contiguous with dual front wall panels to provide a jacket construction.

6. The convertible garment of claim 1, in which said rear wall of said garment is contiguous with a single front wall panel of said garment to provide a vest or tunic construction.

7. The convertible garment of claim 1, in which said lower edge of said second inner rear wall panel section is attached directly to said lower edge of said outer rear wall panel.

* * * * *